US005649435A

United States Patent [19]

Bryant

[11] Patent Number: 5,649,435

[45] Date of Patent: Jul. 22, 1997

[54] CIRCULAR KNITTING MACHINE WITH REPLACEABLE KNITTING HEAD

[75] Inventor: Tim L. Bryant, Campbellsville, Ky.

[73] Assignee: Union Underwear Company, Inc., Bowling Green, Ky.

[21] Appl. No.: 551,812

[22] Filed: Nov. 7, 1995

[51] Int. Cl.[6] ..... D04B 9/00

[52] U.S. Cl. ..... 66/8; 66/19

[58] Field of Search ..... 66/8, 13, 17, 29, 66/57

[56] References Cited

U.S. PATENT DOCUMENTS

| | | | |
|---|---|---|---|
| 1,147,649 | 7/1915 | Scott . | |
| 1,387,783 | 8/1921 | Kunau . | |
| 2,220,230 | 11/1940 | Gilbert . | |
| 3,491,556 | 1/1970 | Mishcon | 66/19 |
| 4,033,147 | 7/1977 | King . | |
| 4,765,155 | 8/1988 | Pernick . | |
| 4,958,507 | 9/1990 | Allaire . | |
| 4,996,852 | 3/1991 | Kawase . | |
| 5,099,661 | 3/1992 | Kitagawa . | |
| 5,195,690 | 3/1993 | Cross . | |
| 5,211,036 | 5/1993 | Engelfried . | |
| 5,224,360 | 7/1993 | Kawase . | |

FOREIGN PATENT DOCUMENTS

| | | | |
|---|---|---|---|
| 1585401 | 9/1969 | Germany | 66/8 |
| 6949 | 1/1979 | Japan | 66/19 |
| 1578661 | 11/1980 | United Kingdom | 66/8 |
| 2073786 | 10/1981 | United Kingdom . | |
| 2131459 | 6/1984 | United Kingdom . | |

OTHER PUBLICATIONS

Knitting Times, vol. 46/6 "Stibbe introduces 5B range of Interchangeable cam models" Singer Knitting Machinery Parts Manual.

*Primary Examiner*—John J. Calvert
*Attorney, Agent, or Firm*—Middleton & Reutlinger; John F. Salazar

[57] ABSTRACT

A tubular knitting machine having a separate take-up assembly and removable knitting head. The knitting head drive mechanism is removably attached to the take-up assembly. A separate drive mechanism is provided for take-up tension and drive rollers. The take-up assembly supports various diameter size needle cylinder and has fully adjustable drive arms for attaching a table-gear of the knitting head to the take-up assembly wherein the take-up assembly of the present invention can support tubular knit rolls of up to 800 pounds.

26 Claims, 10 Drawing Sheets

CIRCULAR KNITTING MACHINE WITH REPLACEABLE KNITTING HEAD

BACKGROUND OF THE INVENTION

1. Field of the Invention

The present invention relates to circular knitting machines which are used to knit tubular fabric. More particularly, the present invention relates to circular knitting machines which have a separate stationary take-up assembly and a replaceable knitting head.

2. Discussion of the Prior Art

Circular knitting machines are well known in the art. Generally, circular knitting machines are utilized to knit tubular fabric having a predetermined diameter, the fabric diameter being determined by the diameter of the needle cylinder. Additionally these machines produce tubular fabric in relatively small rolls, generally about 50 pounds. If one of these machines is placed in a manufacturing facility, should the need for a different size fabric arise, the entire machine must be replaced thereby causing the facility to be idle while the change-over takes place. This is both expensive in lost time and impractical. Thus, there exists a need for a knitting machine which has a standard size take-up which can produce variable diameter tubular knit material and which can support high weight rolls of fabric so that the knitting machine can continue knitting variable diameter tubular fabric rolls for extended periods of time.

SUMMARY OF THE INVENTION

It is therefore an object of the present invention to design a circuluar knitting machine which can produce variable diameter tubular fabric with minimal changes required. The knitting head of the knitting machine must therefore be interchangeable with various other size and type knitting heads. It is a further object of the present invention to provide a circular knitting machine which can produce rolls of tubular fabric up to 800 pounds.

With these objectives in mind, the present invention is directed to a circular knitting machine which has an interchangeable knitting head which rests upon a standard size take-up assembly and take-up cage. The knitting head is securely affixed to a base plate having a hole formed therein, said hole being formed so that the knitted material can drop below the knitting head into the take-up assembly located below. The knitting head is of variable diameter, from about 9 inches to about 32 inches, and has a table gear which is driven by a motor located on the take-up cage. The knitting head is affixed to the base plate in such a manner that the entire knitting head can be readily detached and removed from the take-up cage. The base plate is generally bolted to the take-up cage. The drive system affixed to the take-up cage turns the take-up assembly, table gear of the knitting head and also the quality wheels and feeder assembly, should the machine have such attachments. The drive system is adaptable to knitting heads both having and those without quality wheels. The entire knitting head assembly is removable from and replaceable to the take-up cage with any other size circular knitting head. The take-up assembly is sufficiently supported such that the knitting head may produce large size knitting rolls, up to 800 pounds. The take-up assembly has a separate motor for driving the take-up tension and drive rollers. Attaching the take-up assembly to the table gear are adjustable drive arms which can be variably adjusted for differing diameter needle cylinders and knit material. These adjustable drive arms attach to the take-up assembly and rotate the take-up assembly in unison with the table gear of the knitting head.

More particularly, the present invention comprises a circular knitting machine, comprising a take-up cage, a rotating take-up assembly within said take-up cage and an interchangeable knitting head removably attached to said rotating take-up assembly and said take-up cage.

Other advantages of this invention will appear to those skilled in the art upon reading the following description and appended claims.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
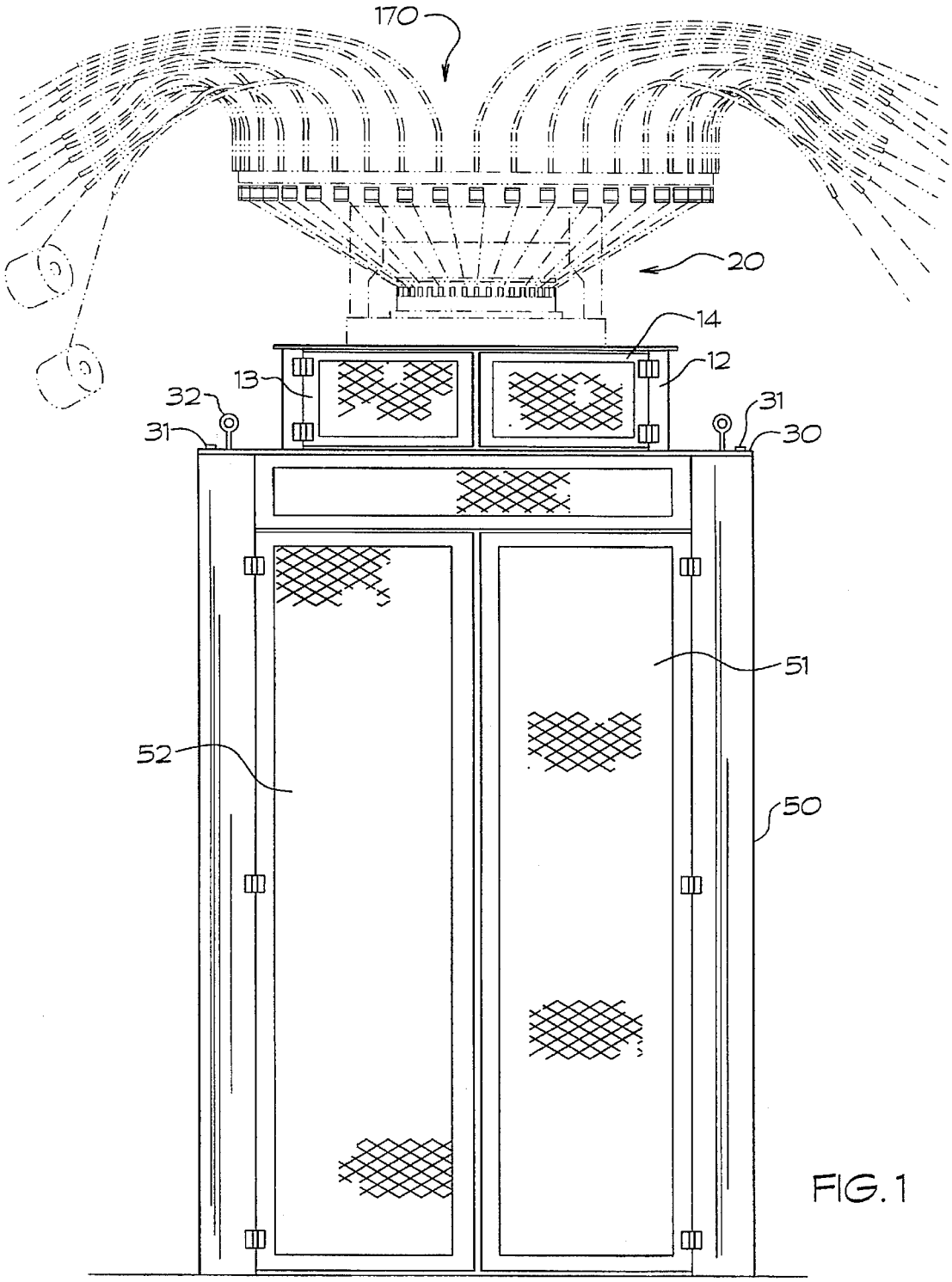
FIG. 1 is a front view of one embodiment of a knitting machine of the present invention utilizing a ribbed knitting head.

One preferred knitting machine 170 of the present invention is shown in FIG. 1. The machine 170 includes a take-up cage 50 and an interchangeable knitting head 20. The take-up cage 50 includes a first housing 12 with access doors 51 and 52 therein which allow an operator means to enter and exit the take-up cage 50. The knitting head 20 is located atop take-up cage 50. Knitting head 20 is securely affixed to base plate 30 wherein the base plate is removably attached to take-up cage 50 with bolts 31. Eye bolts 32 are attached to the upper surface of base plate 30 so the entire knitting head assembly 20 can be hoisted off of take-up cage 50 when changing knitting heads. The knitting machine of this embodiment is provided with a second housing extension 12 positioned above the take-up cage 50. Housing 12 is provided with access doors 13 and 14 for entry to knitting head 20 and fabric located threin. Access to housing extension 12 through access panels 13 and 14 is necessary to properly thread fabric onto the needles located in the needle cylinder 110.

Figure 2:
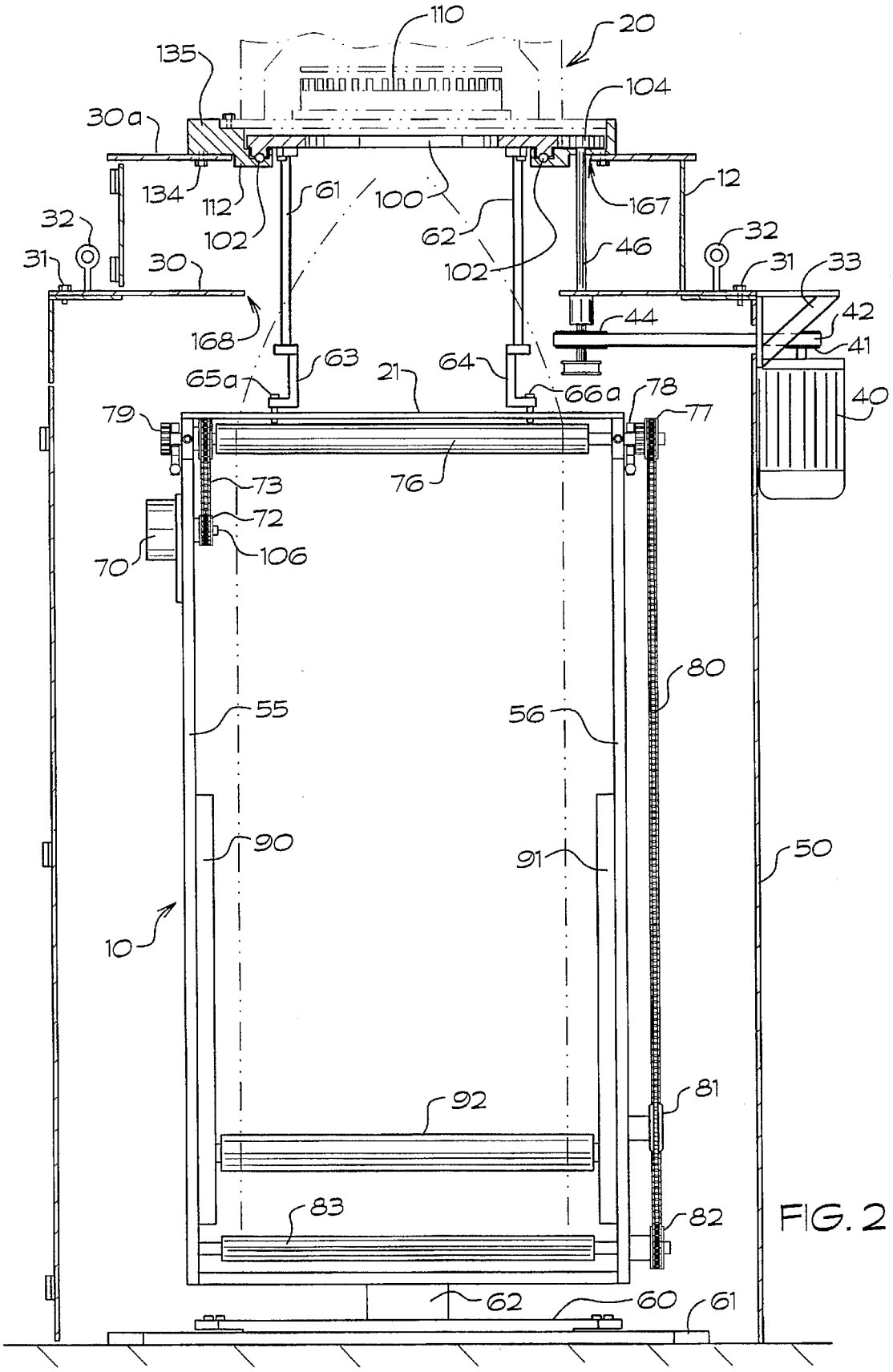
FIG. 2 is a front view of the knitting machine of FIG. 1 showing the interior drive assembly of the take-up assembly.

Take-up assembly 10 is more clearly shown in FIG. 2 which shows in detail the drive system of the take-up rollers 83 and 76 and drive arm assemblies 61 and 62. Generally, needle cylinder 110 rests atop table gear 100 which rotates in clockwise fashion. Tubular fabric knitted by knitting head 20 drops through the openings 167 and 168, table gear 100, in between drive arms 61 and 62, around take-up tension rollers 76, 88, and 89 (shown more clearly in FIG. 6), and down to doff bar 92 where the roll of knitted fabric is formed. Cross bar support member 21 located on the top of take-up assembly 10 provides the point of attachment of the drive arms 61 and 62 to the take-up assembly 10. Cross bar support member 21 has a plurality of holes for attachment of the drive arms thereto.

The take-up assembly 10 is provided with vertically extending side support frame members 55 and 56 with facing doff bar glide channels 90 and 91 formed on inner surfaces of frame member 55 and 56, respectively. Doff bar glide channels 90 and 91 provide the means for doff bar 92 to move vertically as a roll of fabric is formed. The roll of fabric is continually turned by take-up drive rollers 83 and 96 as discussed previously. Drive rollers 83 and 96 rotate in cooperative relationship so that the fabric roll is properly and evenly rotated. Thus, doff bar 92 glides vertically within channels 90 and 91 to accommodate growing fabric rolls formed by knitting head 20.

Take-up assembly 10 has an independent drive system for turning tension rollers 76, 88 and 89 and drive rollers 83 and 96. As shown in FIG. 2, electric servo motor 70 is attached to side support frame member 55. Servo motor 70 may be of standard manufacturing type and power such as a Parvex Servo Motor, 4.5 continuous torq 35 volt motor or the like, which is sufficient to drive the tension rollers 76, 88 and 89 and drive rollers 83 and 96. This is required due to the standard design take-up which is normally powered by the main drive motor 40 which, upon rotating take-up assembly 10, causes gears within turntable 62 to turn which then in turn, drive the take-up drive rollers and tension rollers. However, in this design, inadequate power and large weight rolls cause sudden abrupt movement of the take-up assembly preventing proper rotation of the drive rollers and tension rollers. A separate drive motor is therefore preferred in the knitting machine of the present invention. A separate servo motor 70 is provided because of the increased weight of the fabric roll which may cause abrupt power surges in the rotation of the take-up thereby decreasing the efficiency. And, Servo motor 70 provides smooth rotation of tension rollers 76, 88 and 89 as well as constant rotation of support rollers 83 and 96 which rotate the large roll of fabric.

Drive arms 63 and 64, having extensions 61 and 62, are attached to table gear 100 and rotate in unison with said table gear. Drive arms 63 and 64 are laterally adjustable for various diameter fabric with the use of shear pins 65 and 66 and attachment holes located on take-up cross bar support member 21. The attachment holes located on cross bar support member 21 are spaced apart in such a manner that the drive arms 63 and which may be attached to different diameter needle cylinders, may be securely atttached to the take-up assembly through holes 22 (shown more clearly in FIG. 7).

Figure 3:
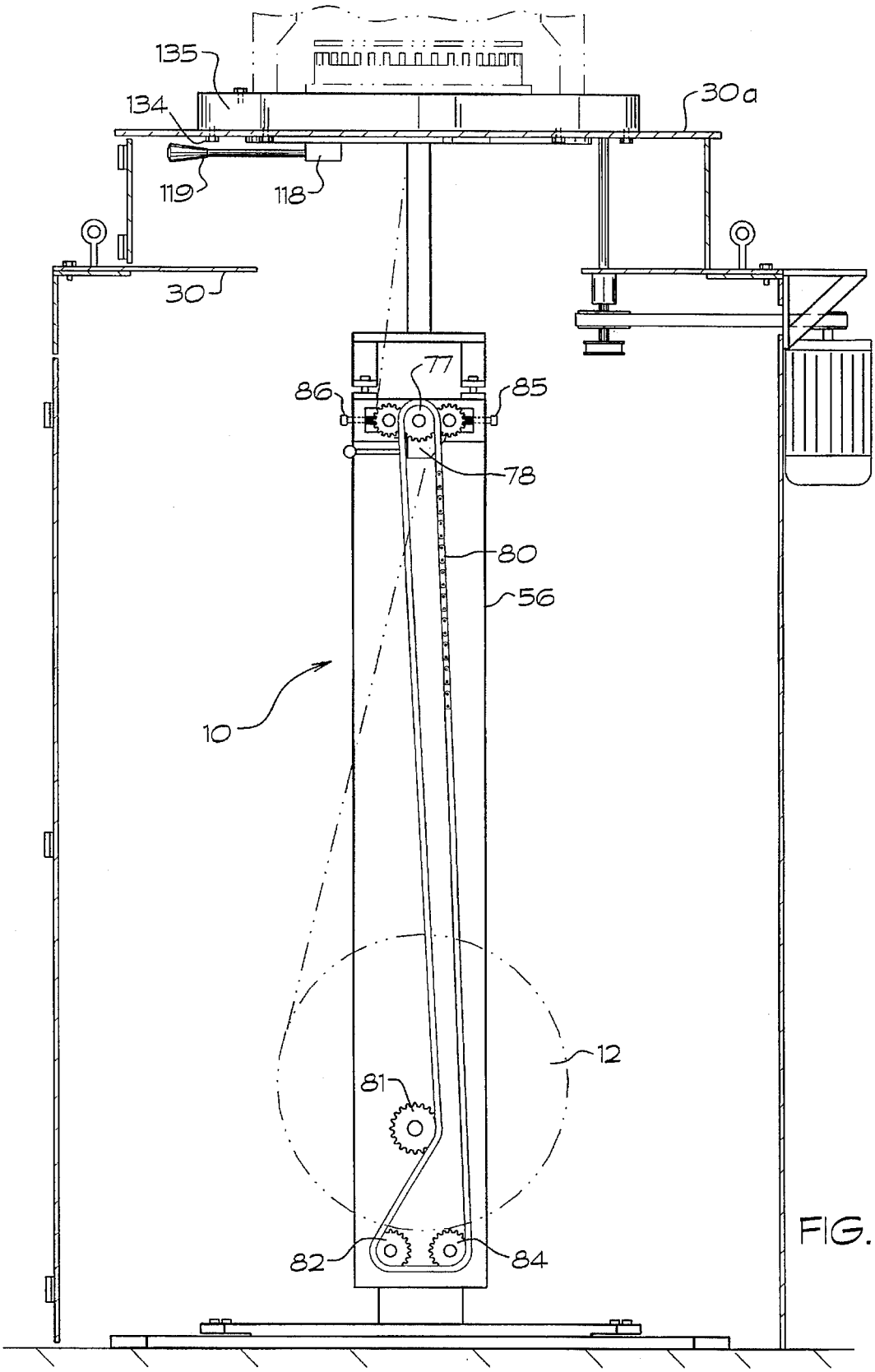
FIG. 3 is a side view of the rotating take-up assembly of the knitting machine in FIG. 2.

Outer sprocket 75 is operative in response to servo motor 70, as discussed hereinafter, and in turn sprocket 77 through center tension roller 88 (shown in FIG. 6). Attached to sprocket 77 is chain 80 which extends down along support side member 56 and in turn drives rollers 83 and 96. As shown in FIG. 3, chain 80 extends downward along side member 56, against idler sprocket 81 and around drive roller sprockets 82 and 84. This arrangement assures cooperative rotation of drive rollers 83 and 96 thereby providing proper rotation of fabric roll 12.

Returning to FIG. 2, take up assembly 10 also is provided with turntable 62 and support legs 60 and 61. Turntable 62 is preferably a bearing type turntable having a bearing race so that the entire take-up assembly 10 can easily rotate upon turntable 62 even with large weight rolls formed therein. Likewise, support legs 60 and 61 are attached together to provide a wider support stance for the rotating take-up assembly 10.

Figure 7:
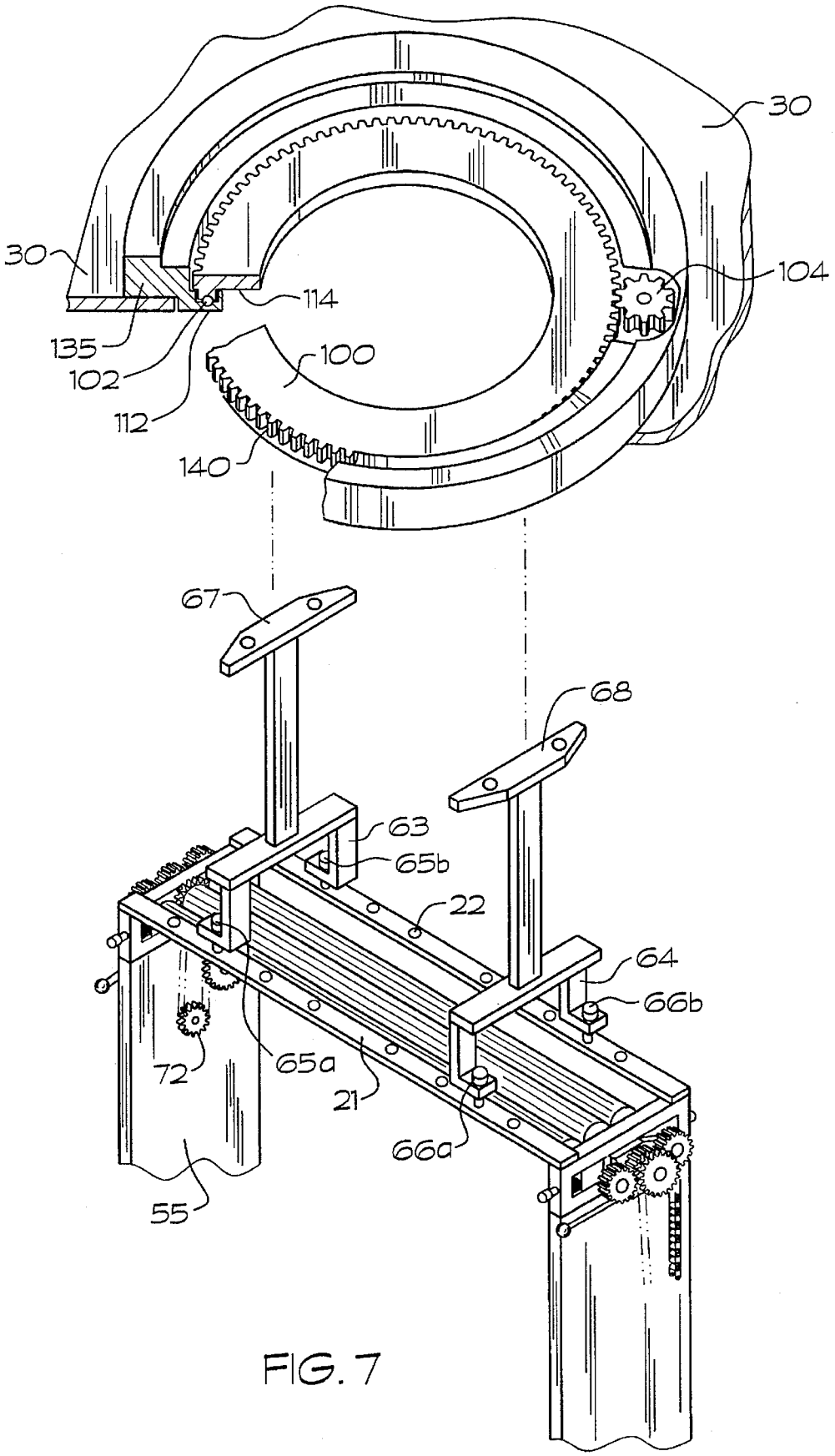
FIG. 7 is an exploded perspective view with selected portions shown cut-away of a table gear and take-up assembly of the knitting machine of FIG. 5.

As best shown in FIG. 2, drive motor 40, which is generally of the type and power such as a 5 horsepower 440 volt 3 phase Vanguard motor, is attached to take-up cage 50. Drive motor 40 provides a means for rotating both the needle cylinder 110 and the take-up assembly 10. Drive motor 40 has a shaft connected to pulley 41 which receives belt 42 therearound. Belt 42 likewise is around pulley 44 which is attached to and rotates drive shaft 46. Drive shaft 46, in turn, is attached at its opposite distal end to table gear sprocket drive 104. Sprocket 104 in response to drive shaft 46 drives the table gear 100 which rotates about bearings and bearing race 102 and 112 respectively, table gear 100 and sprocket 104 having interconnecting teeth as shown in FIG. 7. Attached to take-up cage 50 by L-shaped support bracket 33 is drive motor 40, drive motor 40 being of sufficient power to rotate the table gear 100, knitting head 20 and take-up assembly 10 without undue strain on the motor and produce even rotation of the needle cylinder and take-up assembly.

Also shown in FIG. 2 is base plate 30 and upper base plate **30*a* which have centrally disposed aligned openings therein hole. The openings 167 and 168 formed in base plate 30 and 30*a* are slightly larger than the diameter of the knitting head frame bearing race 112. Thus, knitting head frame 135 has a greater diameter than the opening 167 cut in base plate 30*a* thereby providing adequate support for a needle cylinder 110. Knitting head frame 135 is attached to upper base plate 30*a* with a plurality of threaded studs 134 which are formed along the periphery of frame 135. Additionally, eye bolts 32 attached to the upper surface of plate 30 are provided as the means for attachment to a crane or the like (not shown) for raising the entire knitting head assembly after threaded studs 31 and drive belt 42 have been removed and drive arms 61 and 62 are detached. Generally, a base plate 30 comprised of one-half inch thick metal steel is sufficiently strong enough to support the knitting head 20 and the housing 12. Base plate 30 is also provided with an opening 168 for receiving drive shaft 46 therethrough for driving the turntable drive gear 104. Upper base plate 30*a* is also comprised of one-half inch thick mild steel and is welded to the side of housing 12. Housing 12 is generally approximately 12 inches in height which is sufficient to allow for proper entry into the needle cylinder 110 of knitting head 20**. Access is required in order to place the fabric onto the needles which are located in the needle cylinder.

As shown in FIG. 3, a hand crank 119 is operatively attached to sprocket 118 which in turn is driving table gear 100 (FIG. 2). When manual rotation of the knitting head 20 is required, the operator merely rotates crank 119 to adjust the position of the knitting head 20. Also shown in FIG. 3 and located on take-up 10 and side support member 56 are opposed spring loaded sprocket assemblies 85 and 86 which provide tension on rollers 76 and 89, and additionally hand operated eccentric cam member 78 which will be described in detail below.

Figure 4:
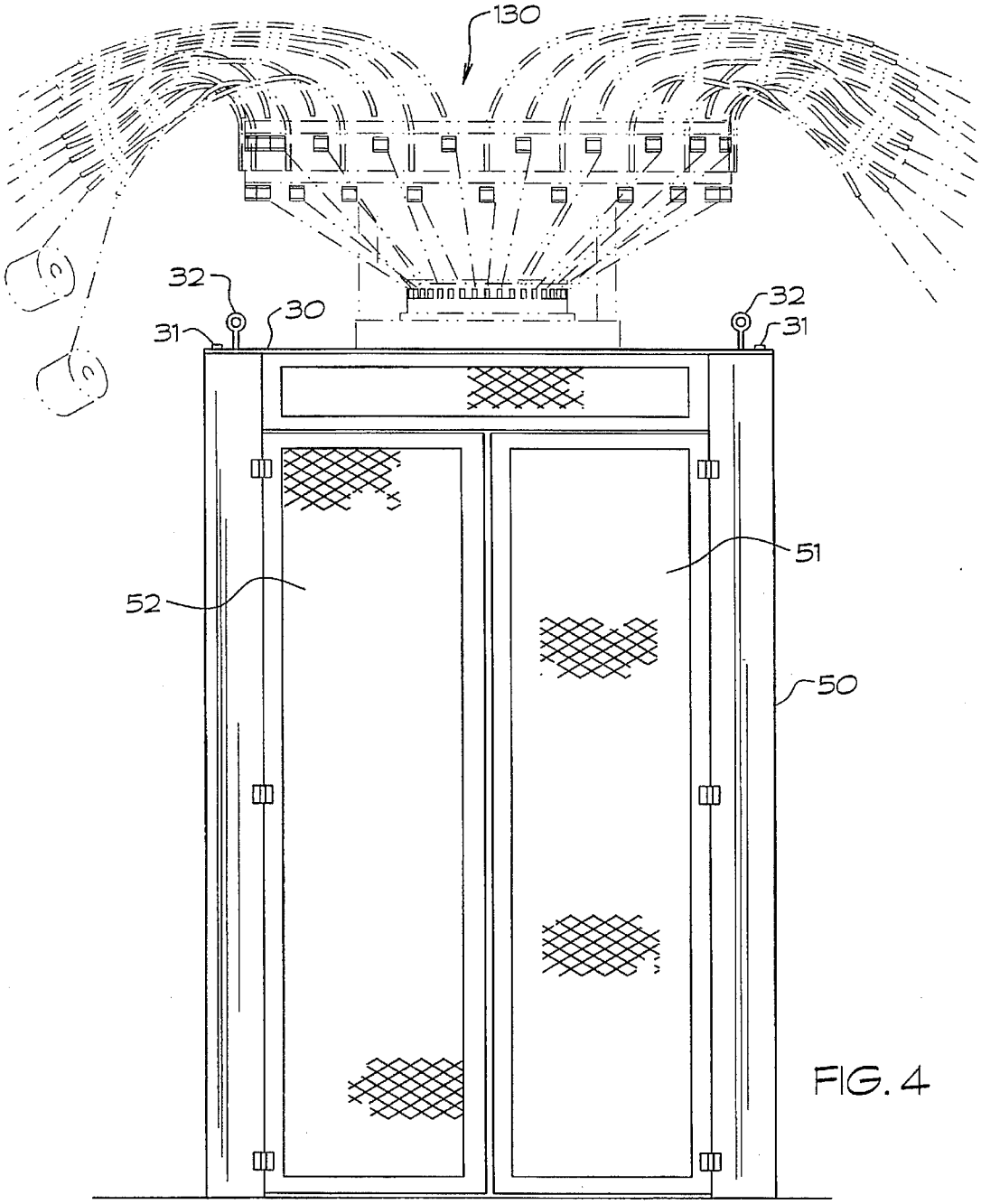
FIG. 4 is a front view of one embodiment of a knitting machine of the present invention utilizing a standard jersey or fleece knitting head.

Shown in FIG. 4 is a front view of a knitting machine of the present invention which has a fleece or jersey type interchangeable knitting head 130. Knitting head 130 is attached to base plate 30 so that the entire knitting head assembly can be removably attached to take-up cage 50. Access doors 51 and 52 may be utilized by the operator to enter into take-up cage 50 in order to remove a roll of knitted fabric or work on the machinery. As with the knitting machine set forth in FIG. 1, knitting head 130 may be removed from the take-up cage 50 by detaching bolts 31 and lifting upwards with a crane, hoist, or the like. The entire knitting head assembly 130 therefore may be removed and replaced with any other type of knitting head required for production without the need of replacing take-up cage 50 or take-up assembly 10.

Figure 5:
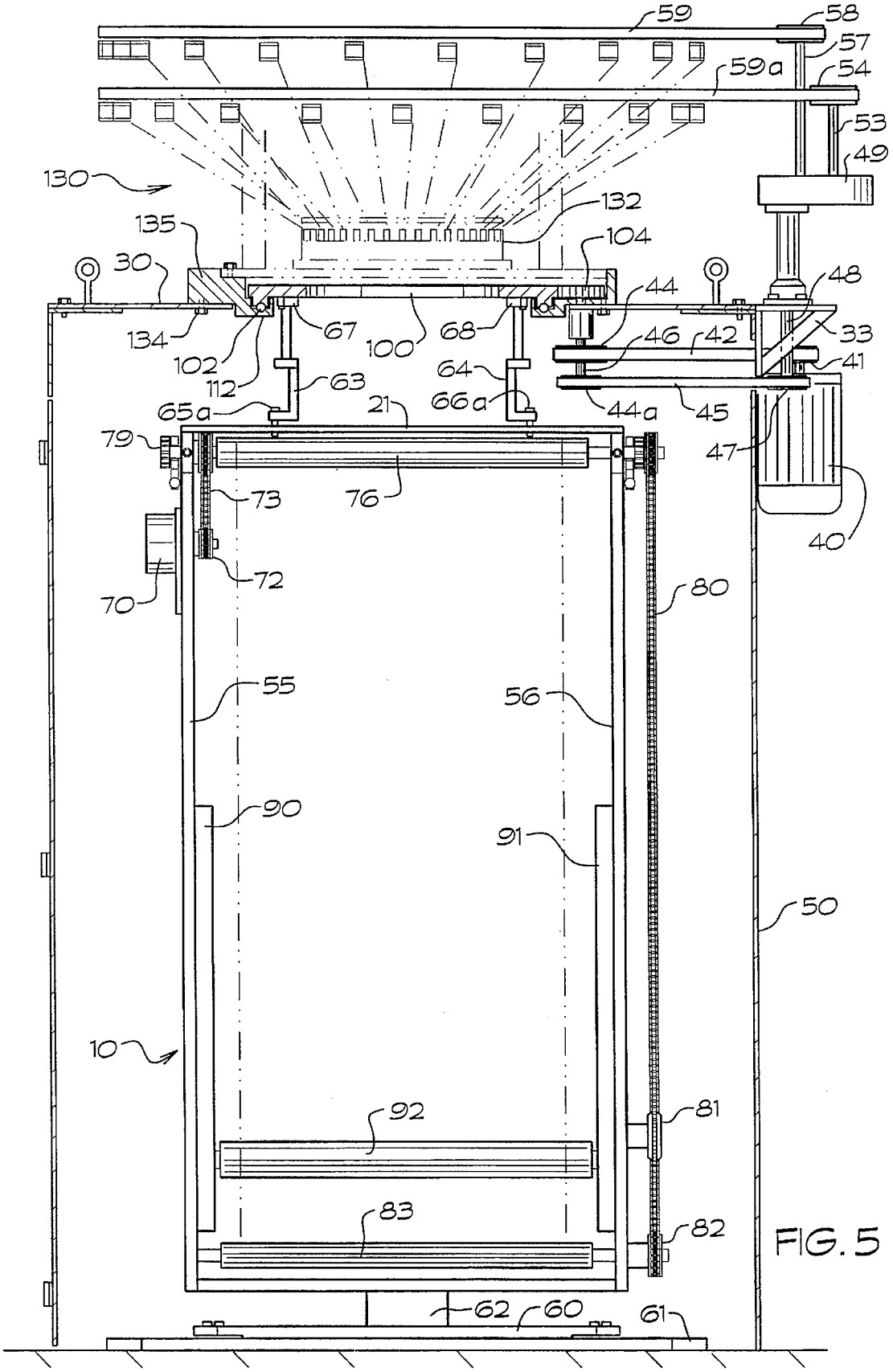
FIG. 5 is a front view of the knitting machine of FIG. 4 showing the interior drive assembly.

In FIG. 5, a front view of the knitting machine of FIG. 4 is shown. Interior of the take-up cage 50 is shown rotating take-up assembly 10 and frame side members 55 and 56 having upper cross bar support member 21 interposed therebetween. Attached to take-up cross bar support 21 is drive arm support brackets 63 and 64 which are attached to cross bar support 21 with shear pins 65*a*, 65*b*, 66*a* and 66*b*, shown more clearly in FIG. 6. Cross bar support members 21, both front and back, have located thereon a plurality of holes 22 for attaching drive arms 63 and 64 thereto. Holes 22 are set apart from each other about 1 inch. For varying diameter knitting heads attached to the top of take-up cage 50, drive arms 63 and 64 may be adjusted to the correct diameter. Attachment holes 21 allow drive arms 63 and 64 to be set anywhere between 9 inches and 32 inches. Upper drive arm support attachment brackets 67 and 68 are affixed to the lower plate of table gear 100, as shown in FIG. 5. Thus, the rotation of table gear 100 is matched by drive arms 63 and 64 causing the entire take-up cage 50 to rotate at the same speed. Fabric material knitted by the needle cylinder 132 of knitting head 130 drops below knitting head 130 in between drive arms 63 and 64, around tension rollers 76, 88 and 89 and to the fabric roll formed around doff bar 92.

Returning to FIG. 5, base plate 30 forms the support base for knitting head 130. Knitting head 130 is attached to base plate 30 with a series of threaded studs 134 encircling the knitting head frame 135. Disposed within the knitting head frame 135 is a bearing race 112 within which the bearings 102 are located allowing the needle cylinder 132 to easily rotate. Table gear 100, located directly below needle cylinder 132, has an outer periphery of gear teeth 140 which mesh with drive sprocket 104 so that the entire table gear 100 including needle cylinder 132 and take-up drive arms 63 and 64 rotate. Drive sprocket 104 is driven by drive shaft 46 which has main drive pulley 44 affixed thereto. Drive pulley 44 is turned by belt 42 which is attached to drive motor pulley 41 located atop drive motor 40.

Located directly below main drive pulley 44 is secondary drive pulley 44*a* which provides a means for driving quality wheels 54 and 58. A polychain belt 45 is provided to turn pulley 47 and drive shaft 48 of feeder assembly 49. Dual quality wheel pulleys 54 and 58 are attached to feeder assembly 49 through drive shafts 53 and 56 in order to turn feeder wheels 59 and nylon belt 59*a*. An L-shaped support bracket 33 is attached to take-up cage 50 in order to support the wheels and feeder assembly 49.

As with the knitting machine shown in FIG. 2, doff bar 92 is held within glide channels 90 and 91 so that doff bar 92 may move vertically as the roll of tubular fabric formed thereon grows. In use, the roll of fabric may approach 800 pounds. The roll of fabric is turned by drive rollers 83 and 96 so that the take-up adequately rolls the fabric onto the fabric roll. Drive rollers 83 and 96 are turned by drive shaft sprockets 82 and 84 in cooperative rotational relationship, as shown in FIG. 3. Idler sprocket 81 is provided to ensure adequate tension on chain 80.

Figure 6:
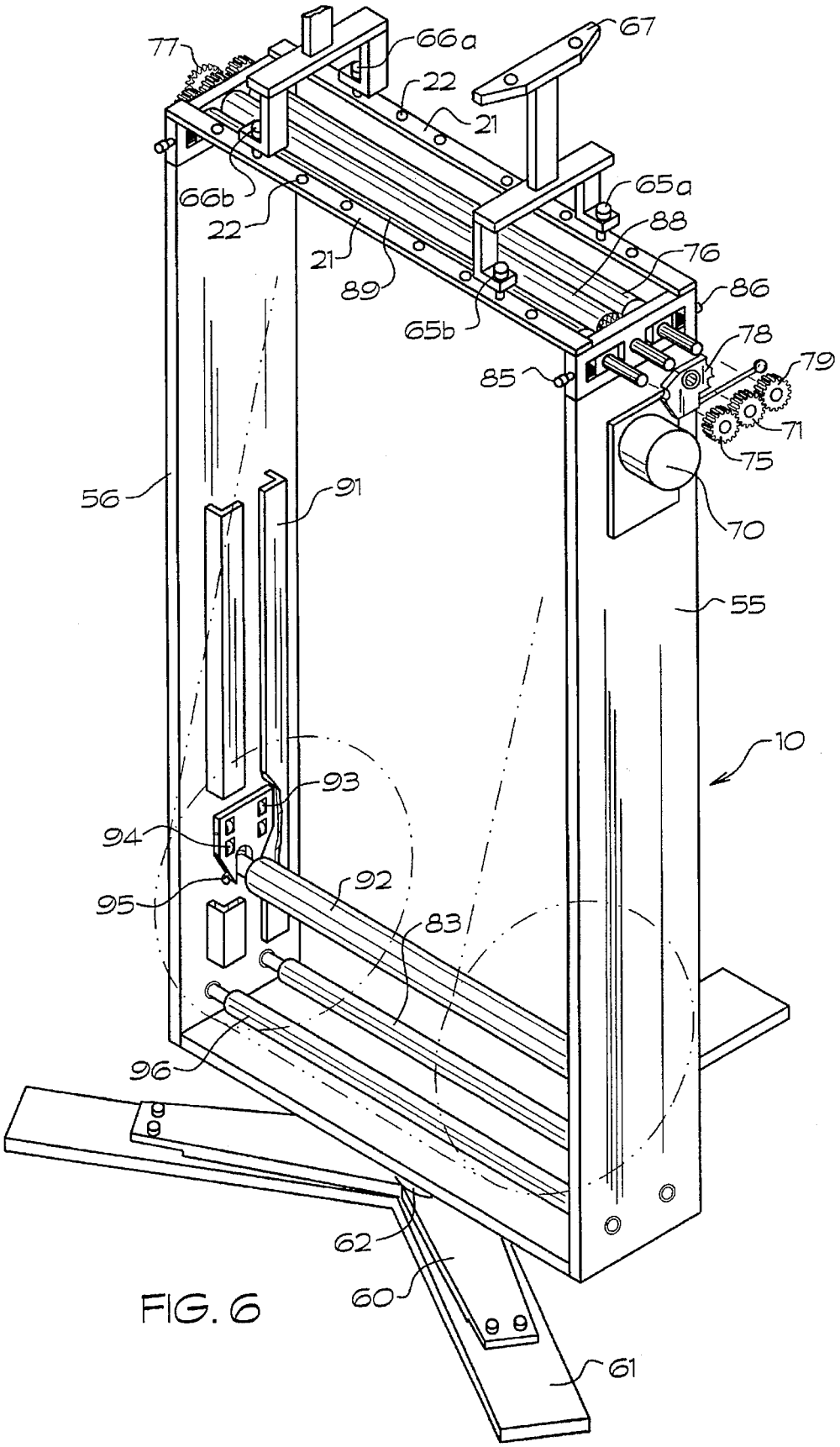
FIG. 6 is a perspective view of the take-up assembly of the knitting machine of FIG. 5.

Shown in FIG. 6 is an exploded view of the take-up tension drive roller gears 75, 71 and 79. As shown, tension rollers 89, 88 and 76 are turned by servo motor 70. Tension roller bars 76 and 89 are spring tension adjustable in order to properly set the tension rollers 76 and 89 against center roller 88. Tubular fabric formed by the knitting head enters between rollers 89 and 88, back up around roller 76 and then down to doff bar 92. The center shaft of the rollers 89, 88 and 76 have attached to them sprockets 75, 71 and 79. This enables the driven center roller 88, which is driven by servo motor 70, to turn outer tension rollers 75 and 89. Eccentric cam member 78 with a handle extending outward therefrom is provided to disengage spring loaded outer rollers 76 and 89 and additionally has located thereon a kill switch for shutting off servo motor 70 whenever the handle is utilized thereby discontinuing rotation of the take-up drive rollers. Both ends of the tension rollers 75 and 89 have an eccentric located thereon for releasing the spring tension applied to center roller 88.

Also more clearly shown in FIG. 6 is support base legs 60 and 61 which provide an increased width stance than usually used for support members in order to adequately hold the increased weight of the larger fabric rolls. Each leg of support base 61 is about three feet long. Support legs 60 and 61 are generally mild steel and have sitting atop them turntable 62 for rotating the take-up frame 55 and 56 and assembly.

Referring now to FIG. 7, there is shown a cut-away view of the table gear 100 attached to base plate 30. Knitting head frame 135 has bearing race 112 formed therein which contain bearings 102. Table gear 100 rotates about bearings 102 while being driven by drive sprocket 104. Attachment brackets 67 and 68 of drive arms 63 and 64 are attached on interior rim 114 of table gear 100. Shear pins 66*a* and 66*b* are attached to drive arms 64 and shear pins 65*a* and 65*b* are attached to drive arm 63 in order to allow the drive arms to break away from take-up cross bar support member 21 should a roll of fabric become dislodged or a knitting element break or lock. This protects the knitting elements located in the needle cylinder.

Figure 8:
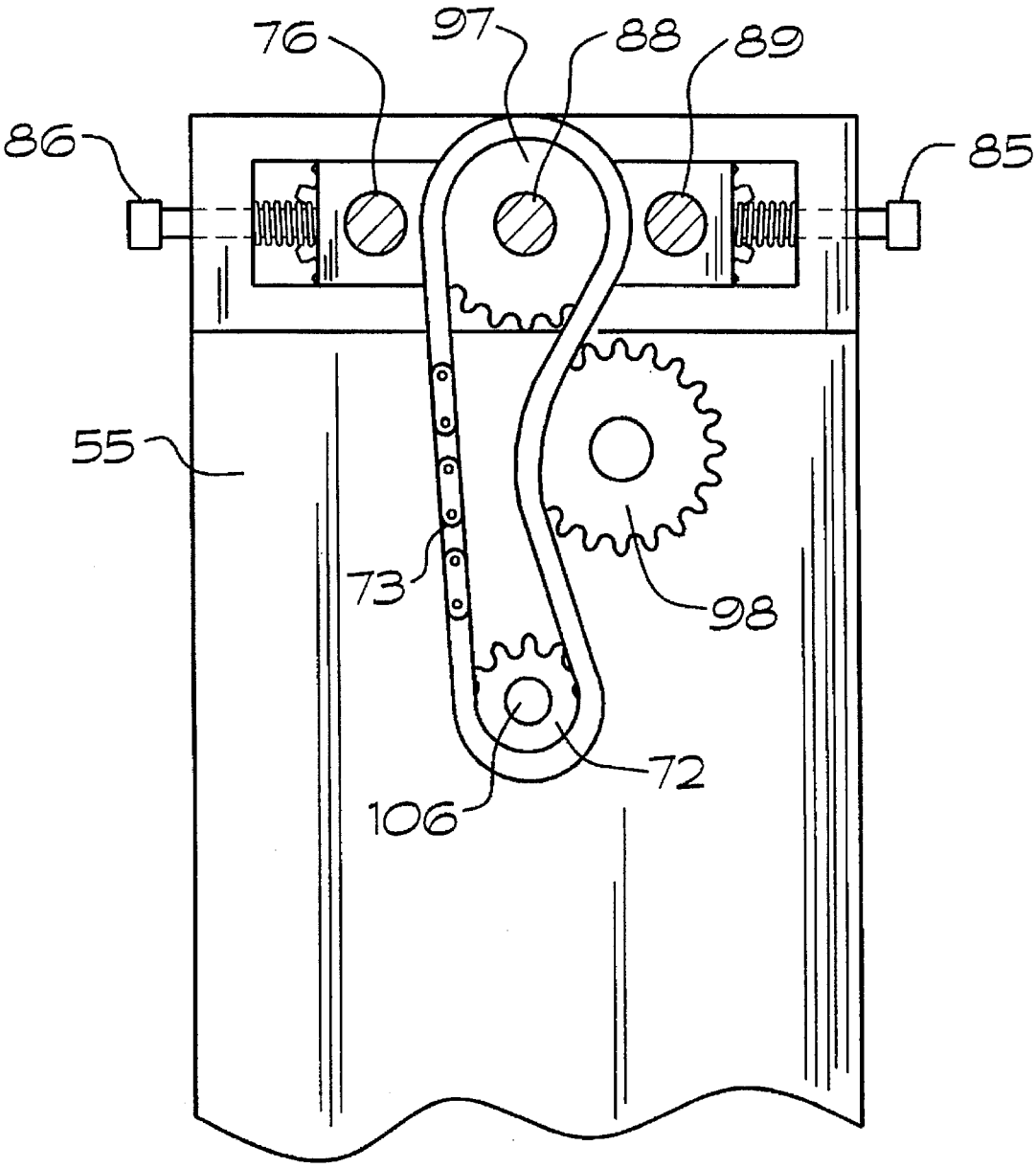
FIG. 8 is a selected portion of a side view of the interior of a take-up drive system of the present invention.

Shown in FIG. 8 is the interior of support side frame 55 of take-up assembly 10. Servo motor 70 with shaft 106 extending through frame 55 is attached to sprocket 72. Sprocket 72 receives chain 73 therearound which in turn is wound around sprocket 97 of center tension bar 88. Outer tension bars 76 and 89 are provided with spring tension adjusting through adjustment screws 85 and 86 to adjust the amount of tension the outer tension rollers force against center roller 88. Idler sprocket 98 is provided in order to adjust the tension of chain 73. Outer tension rollers 89 and 76 are turned by the sprocket drive assembly set forth in FIG. 6.

Figure 9:
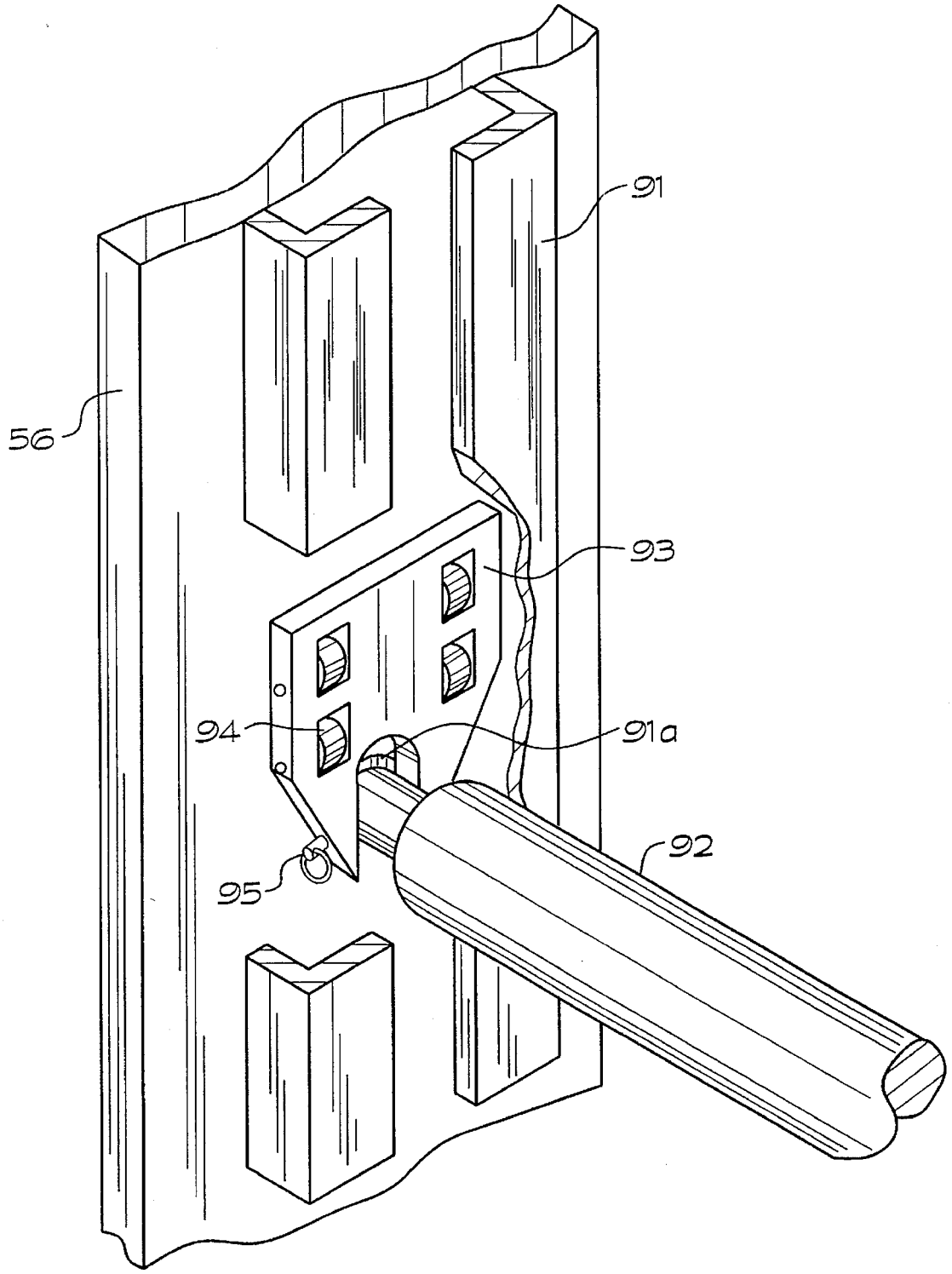
FIG. 9 is a perspective view of a doff bar and support track of the take-up assembly of the present invention; and, FIG. 10 is a top view of the table gear and feeder assembly of the knitting machine of FIG. 5.

FIG. 9 shows the channel guide 90 for doff bar 92. An aluminum block 93 having a plurality of wheels 94 is provided which allow the block 93 to glide vertically within channel guide 90. Block 93 is retained within channel guide 90 allowing block 93 to vertically move within said channel as the material wound around doff bar 92 grows. Channel guide 90 is formed about 3 feet along the side frame 55 and 56. At the end of doff bar 92 is flange 91 to prevent lateral movement of doff bar 92. Flange 91 securely holds the end of the doff bar within and behind aluminum block 93. Doff bar 92 is also held within the U-shaped channel formed in the block 93 retaining pin 95, pin 95 providing means for detachably retaining doff bar 92 within block 93. Under normal use conditions, block 93 rests upon doff bar 92 and guides the bar upwards as the roll formed thereon begins to grow.

Figure 10:
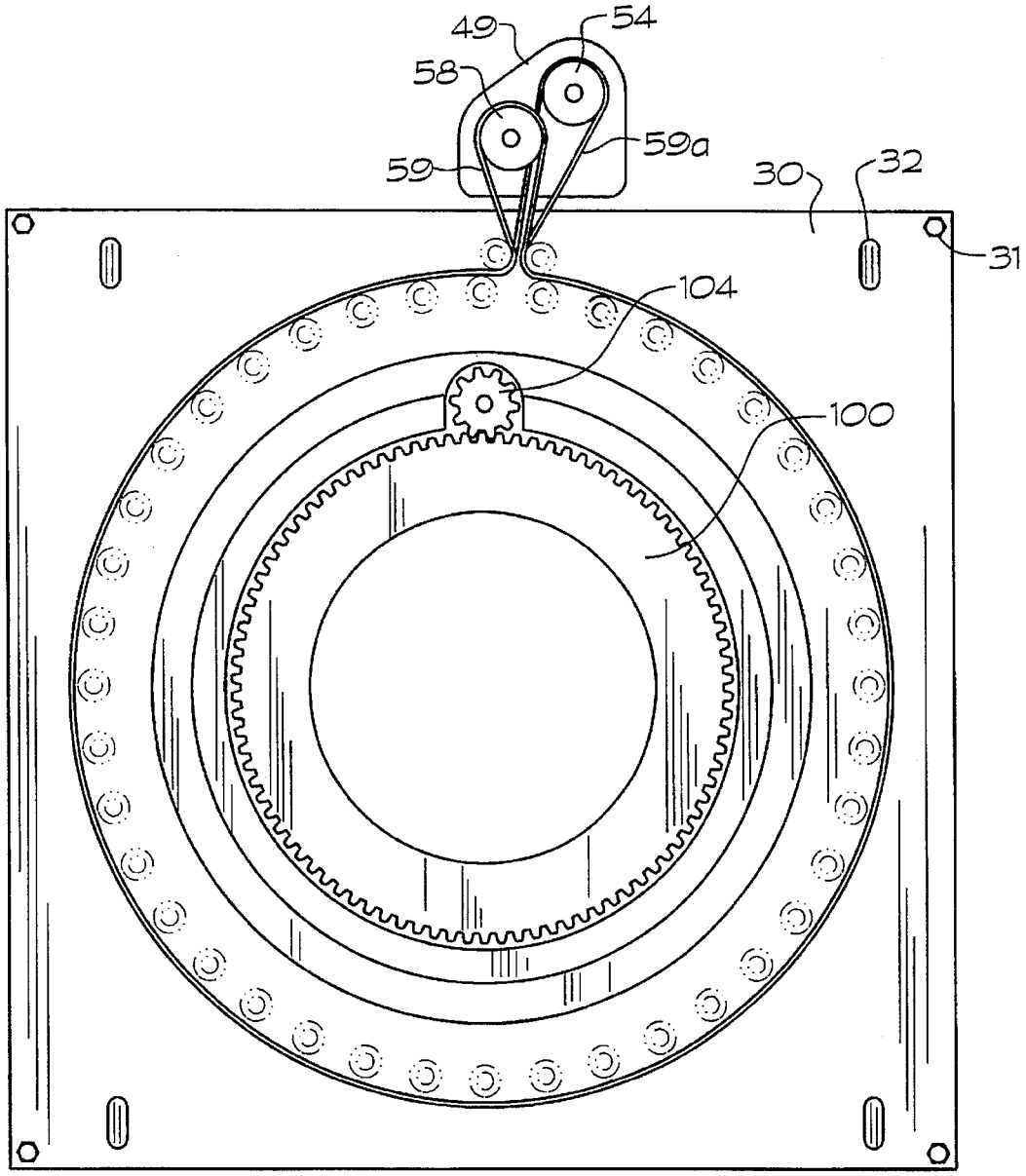

FIG. 10 shows an upper view of the table gear 100 and table gear drive 104 of the knitting head. Feeder assembly 49 and quality wheels 54 and 58 as well as belts 59 and 59*a* are also shown. Base plate 30 having threaded studs 31 and eye bolts 32 for raising the knitting head off of the take-up assembly are also detailed.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed:

1. A circular knitting machine, comprising:

a take-up cage;

a rotating take-up assembly within said take-up cage; and, an interchangeable knitting head removably attached to said rotating take-up assembly and said take-up cage, said interchangeable knitting head having one of a plurality of diameters.

2. The circular knitting machine of claim 1 further comprising a first and a second adjustable drive arm extending vertically downward from said knitting head and removably attached to said rotating take-up assembly.

3. The circular knitting machine of claim 2 wherein said knitting head has a table gear attached thereto, said table gear attached to said first and said second drive arms.

4. The circular knitting machine of claim 2 wherein said first and second drive arms are horizontally adjustable on said take-up assembly.

5. The circular knitting machine of claim 3 further comprising a drive motor attached to said take-up cage, said drive motor operably connected to said table gear.

6. The circular knitting machine of claim 5 further comprising at least one quality wheel located on said knitting head, said at least one quality wheel operably attached to said drive motor.

7. The knitting machine of claim 1 wherein said rotating take-up assembly has a first and a second vertically extending side support member and a doff bar interposed therebetween.

8. The knitting machine of claim 7 wherein said take-up assembly has a vertically extending first and second doff bar channel guide in spaced cooperative relation on opposite sides of said first and second side support member.

9. The knitting machine of claim 8 further comprising a first and second block vertically movably within said first and second doff bar channel guide, said first and second block detachably retaining said doff bar.

10. The knitting machine of claim 9 wherein said first and second block have located thereon at least one wheel.

11. The knitting machine of claim 7 wherein said rotating take-up assembly is further comprised of a first, second and third tension roller in side by side relationship interposed between said first and said second side support members.

12. The knitting machine of claim 7 wherein said rotating take-up assembly is further comprised of a first and a second drive roller interposed between said first and second side support member and below said doff bar.

13. The knitting machine of claim 11 wherein said tension rollers are rotated by drive means affixed to said rotating take-up assembly.

14. The knitting machine of claim 12 wherein said drive rollers are rotated by drive means affixed to said rotating take-up assembly.

15. A circular knitting machine, comprising:

a take-up cage;

a replaceable knitting head having a table gear, said knitting head removably attached to said take-up cage;

a rotating take-up assembly housed within said take-up cage;

a first and a second adjustable drive arm extending downward from said table gear and removably attached to said rotating take-up assembly.

16. The knitting machine of claim 15 wherein said take-up assembly has a vertically movable doff bar interposed between a first and a second side support member.

17. The knitting machine of claim 16 wherein said take-up assembly has a vertically extending first and second doff bar channel guide in spaced cooperative relation on opposite sides of said first and second side support members.

18. The knitting machine of claim 15 wherein said drive arms are laterally adjustable on said rotating take-up assembly from about 9 inches to about 32 inches.

19. The knitting machine of claim 16 wherein said rotating take-up assembly is further comprised of a cross bar support interposed between said first and second side support members, said first and second drive arms removably attached to said cross bar support.

20. The knitting machine of claim 19 wherein said cross bar support has located thereon a plurality of connecting holes for receiving said first and said second drive arms.

21. The knitting machine of claim 15 further comprising drive means affixed to said take-up cage, said drive means having means for rotating said knitting head and said take-up assembly.

22. The knitting machine of claim 15 wherein said rotating take-up assembly is further comprised of:

tension rollers for pulling fabric formed by said knitting head; and, drive rollers for rotating a roll of fabric formed in said take-up assembly.

23. The knitting machine of claim 22 wherein said take-up assembly has drive means for rotating said tension rollers and said drive rollers.

24. The knitting machine of claim 17 further comprising a first and second aluminum block detachably retaining each end of said doff bar.

25. The knitting machine of claim 24 wherein said first and second block are retained within said first and second channel guide.

26. The knitting machine of claim 24 wherein said first and second block have at least one wheel located thereon.

* * * * *